US005397084A

United States Patent [19]

Wang

[11] Patent Number: 5,397,084

[45] Date of Patent: Mar. 14, 1995

[54] SUPPORTING FRAME FOR A GOLF BAG

[76] Inventor: Ming-Tsang Wang, P.O. Box 82-144, Taipei, Taiwan, Prov. of China

[21] Appl. No.: 280,071

[22] Filed: Jul. 25, 1994

[51] Int. Cl.[6] ..... A63B 55/00

[52] U.S. Cl. ..... 248/96; 206/315.7; 248/165

[58] Field of Search ..... 248/96, 171, 165; 206/315.6, 315.7, 315.3; 211/70.2

[56] References Cited

U.S. PATENT DOCUMENTS

| | | | |
|---|---|---|---|
| 4,798,357 | 1/1989 | Cho | 248/165 X |
| 5,082,218 | 1/1992 | Hoffman | 206/315.5 X |
| 5,147,089 | 9/1992 | Anderson | 248/96 |
| 5,154,377 | 10/1992 | Suk | 206/315.7 X |
| 5,156,366 | 10/1992 | Anderson | 248/171 X |
| 5,178,273 | 1/1993 | Igarashi | 206/315.7 |
| 5,209,350 | 5/1993 | Maeng | 206/315.7 |
| 5,303,888 | 4/1994 | Seop | 206/315.6 X |

FOREIGN PATENT DOCUMENTS

| | | | |
|---|---|---|---|
| 105469 | 8/1938 | Australia | 248/96 |
| 677333 | 8/1952 | United Kingdom | 248/96 |

*Primary Examiner*—J. Franklin Foss
*Attorney, Agent, or Firm*—Alfred Lei

[57] ABSTRACT

A supporting frame for a golf bag including a seat having an enlarged portion and a flange at both sides of the enlarged portion, the flange being riveted on an upper portion of a golf bag, the enlarged portion having a recess at a bottom and between two shoulders, two blocks depending downwardly from a top surface of the recess and being each formed with an elongated slot, the recess having a rear side provided with a rail, a pair of legs each formed at an upper end with a horizontal portion having a threaded hole, each of the legs being fixedly connected with the seat by a bolt, a connecting member inserted into the rail of the seat and having two lugs between which is fitted an end of a spring, and a handle engaged with the connecting member by a pin extending through the two lugs of the connecting member and a partition of the locking handle whereby the legs will expand to support the golf bag at an upright position simply by pulling the handle outward.

1 Claim, 3 Drawing Sheets

SUPPORTING FRAME FOR A GOLF BAG

BACKGROUND OF THE INVENTION

Golf is a game of hitting a small hard ball with specially made clubs over an outdoor course. The object is to deposit the ball in a specified number of cups, or holes, using as few strokes as possible. Generally, many golfers utilize a golf bag to carry their golf clubs around the golf course. However, such a golf bag is made of cloth and cannot stand firmly on the ground by itself thereby causing much inconvenience in use.

Therefore, it is an object of the present invention to provide a supporting frame for a golf bag which can obviate and mitigate the above-mentioned drawback.

SUMMARY OF THE, INVENTION

This invention relates to a supporting frame for a golf bag.

It is the primary object of the present invention to provide a supporting frame for a golf bag which enables a golf bag to stand firmly on the ground.

It is another object of the present invention to provide a supporting frame for a golf bag which is easy to operate.

It is still another object of the present invention to provide a supporting frame for a golf bag which is simple in construction.

It is still another object of the present invention to provide a supporting frame for a golf bag which is facile to manufacture.

It is a further object of the present invention to provide a supporting frame for a golf bag which is fit for practical use.

The other objects and merits and a fuller understanding of the present invention will be obtained by those having ordinary skill in the art when the following detailed description is read in conjunction with the accompanying drawings wherein like numerals refer to like or similar part.

DETAILED DESCRIPTION OF THE PREFERRED EMBODIMENT

Figure 1:
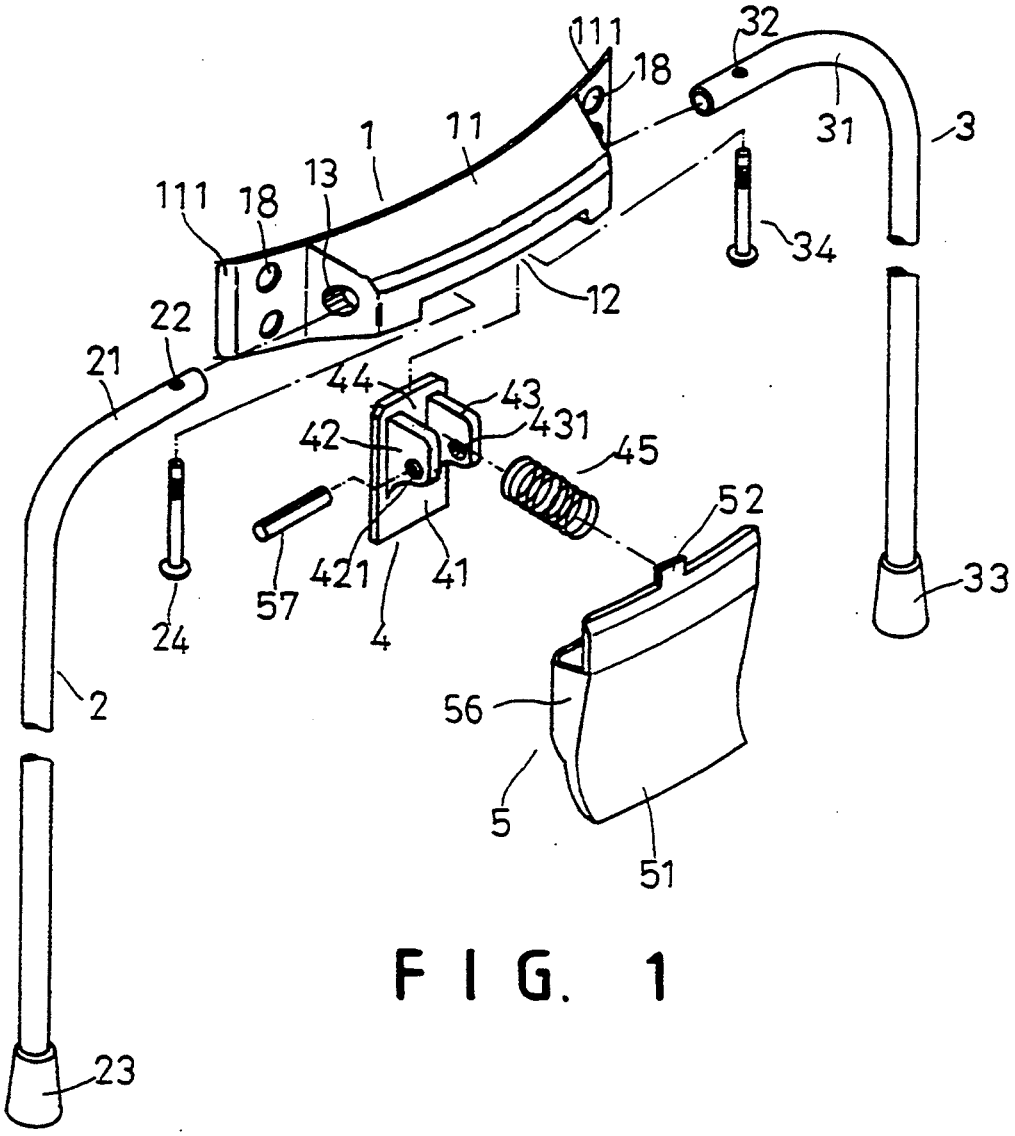
FIG. 1 is an exploded view of the present invention.

For the purpose of promoting an understanding of the principles of the invention, reference will now be made to embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
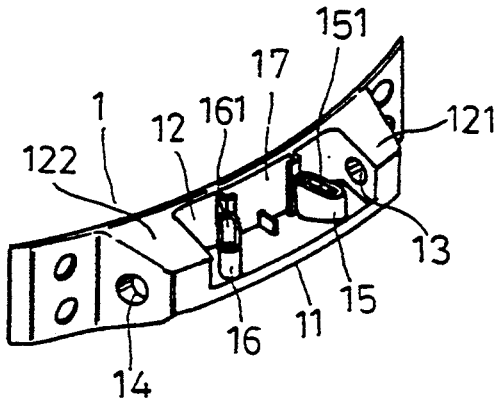
FIG. 2 shows the bottom side of the seat.
Figure 3:
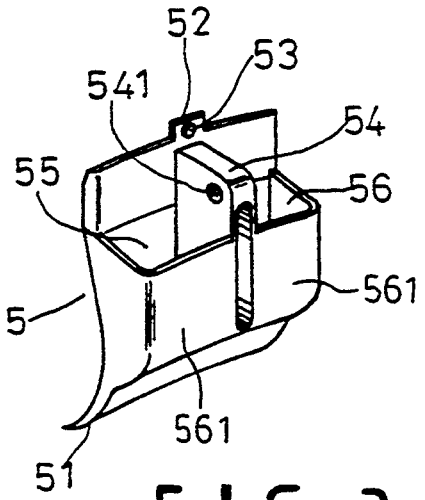
FIG. 3 shows the rear side of the handle.

With reference to the drawings and in particular to FIGS. 1, 2 and 3 thereof, the supporting frame for a golf bag according to the present invention mainly comprises a seat 1, two legs 2 and 3, a connecting member 4, and a handle 5.

As illustrated, the seat I includes an enlarged portion 11 at the middle and a flange 111 at both ends thereof. The enlarged portion 11 has a recess 12 at the bottom and between two shoulders 121 and 122. The shoulders 121 and 122 are respectively formed with holes 13 and 14 which are aligned with each other. From the top surface of the recess 12 downwardly depend two blocks 15 and 16 respectively having elongated slots 151 and 161. Further, the rear side of the recess 12 is provided with a rail 17 and the flange 111 has two fixing holes 18.

The legs 2 and 3 are respectively formed with at the upper end with horizontal portions 21 and 31 which are formed with threaded holes 22 and 32 respectively. In addition, the legs 2 and 3 are respectively provided with rubber caps 23 and 33. The horizontal portions 21 and 31 are respectively inserted into the holes 13 and 14 of the seat 1. The threaded holes 22 and 32 of the legs 2 and 3 are respectively aligned with the slots 151 and 161 of the blocks 15 and 16. The legs 2 and 3 are fixedly connected with the seat 1 by two bolts 24 and 34 respectively extending through the threaded holes 22 and 32 into the slots 151 and 161 of the blocks 15 and 16.

The connecting member 4 is a plate 41 formed at one side with two lugs 42 and 43 which respectively have holes 421 and 431. Between the two lugs 42 and 43 there is a space 44 in which is fitted a spring 45. The connecting member 4 is inserted into the rail 17 of the seat 1, with its lugs 42 and 43 remote from the rail 17.

The handle 5 is a pocket-like member having a front side with a grip portion 51 curving outward at the lower part and a protuberance 52 at the upper edge. The protuberance 52 is formed with a projection 53 at the inner side. At the intermediate portion of the inner side of the handle 5 there is a partition 54 having a hole 541 at the upper portion and dividing the handle 5 into two open top chambers 54 and 55. The handle 5 is engaged with the connecting member 4, with the partition 54 fitted between the two lugs 42 and 43 of the connecting member 4, the holes 421 and 431 of the connecting member 4 aligned with the hole 541 of the partition 54, and the projection 53 of the handle 5 engaged with the other end of the spring 45. A pin 57 extends through the holes 421, 541 and 431 to connect the handle 5 with the connecting member 4.

Figure 4:
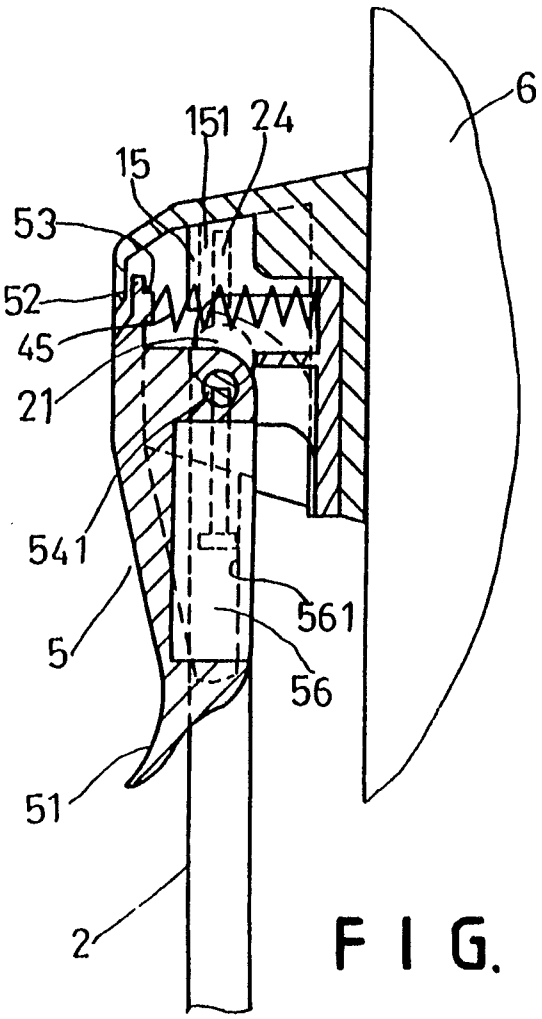
FIG. 4 is a sectional view showing the collapsed condition of the present invention.
Figure 6:
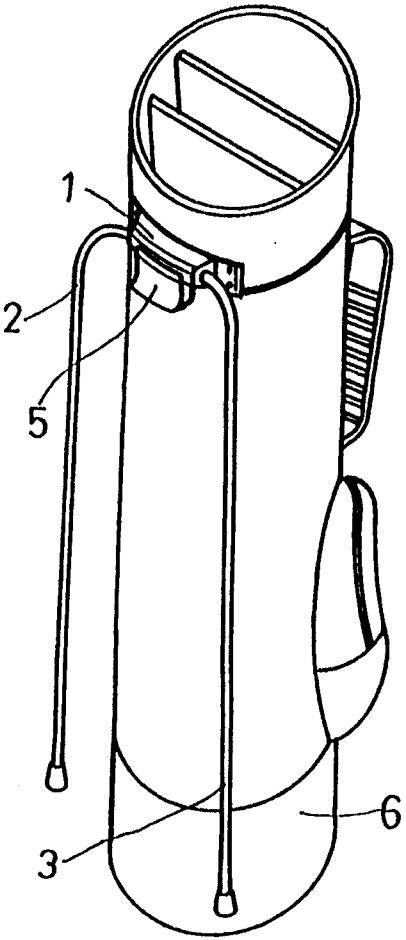
FIGS. 6 and 7 are working views of the present invention.

As shown in FIGS. 4 and 6, the seat 1 is fixedly mounted on one side of a golf bag 6 by rivets (not shown) extending through the holes 18 and the golf bag 6. When the supporting frame according to the present invention is not in use, the bolts 24 and 34 are located at an vertical position with their upper ends bearing against the outer ends of the slots 151 and 161 of the blocks 15 and 16 and their lower ends bearing against the rear side 561 of the chambers 55 and 56 of the handle 5, thereby keeping the legs 2 and 3 at a collapsed condition.

Figure 5:
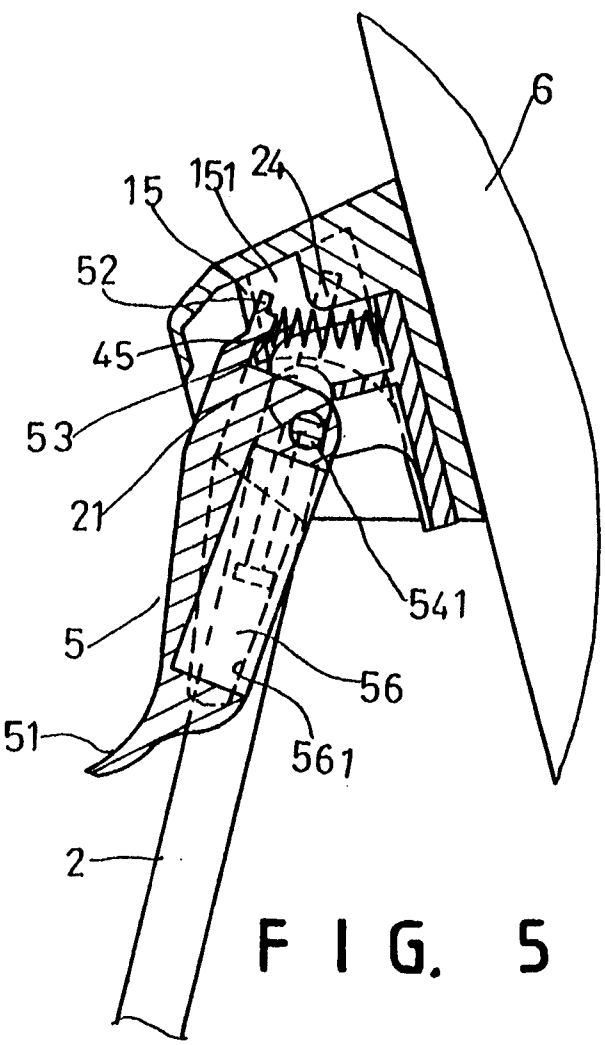
FIG. 5 is a sectional view showing the expanded condition of the present invention.
Figure 7:
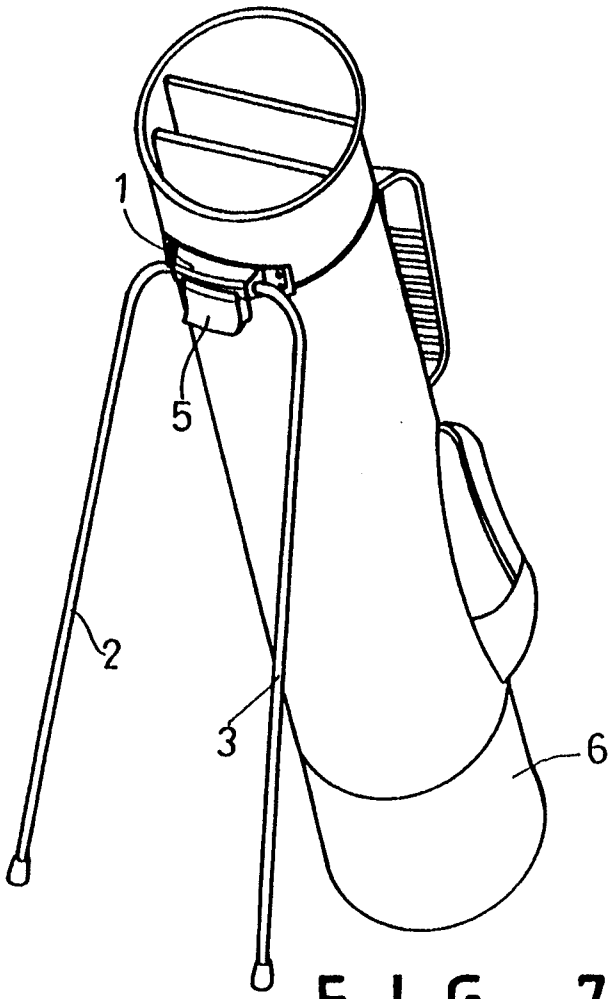

Referring to FIGS. 5 and 7, when desired to open the legs 2 and 3, it is only necessary to pull the grip portion 51 of the handle 5 outward until the upper edge of the handle 5 is in contact with the blocks 15 and 16 of the seat I so that the rear side 561 of the chambers 55 and 56 of the handle 5 will force the lower ends of the bolts 24 and 34 to go outward and the upper ends of the bolts 24 and 34 to move to the inner ends of the slots 151 and 161 of the blocks 15 and 16 thereby moving the legs 2 and 3 outwards and sidewards. When desired to fold the legs 2 and 3, simply lift the golf bag 6 so that the spring 45 will push the legs 2 and 3 to move towards the golf bag 6.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A supporting for a golf bag comprising:

a seat including an enlarged portion and a flange at both sides of said enlarged portion, said flange being riveted on an upper portion of a golf bag, said enlarged portion having a recess at a bottom and between two shoulders, each of said shoulders being formed with a hole, two blocks depending downwardly from a top surface of said recess and being each formed with an elongated slot, said recess having a rear side provided with a rail;

a pair of legs each formed at an upper end with a horizontal portion having a threaded hole, each of said horizontal portion being inserted into the hole of said seat, the threaded hole of said horizontal portion being aligned with the slot of each of said blocks, each of said legs being fixedly connected with said seat by a bolt extending through the threaded hole of said legs and the slot of said blocks;

a connecting member inserted into the rail of said seat and having two lugs between which is fitted an end of a spring; and a handle having a partition dividing said handle into two open top chambers, said handle being engaged with said connecting member by a pin extending through the two lugs of said connecting member and the partition of said handle, said partition of said handle being fitted between the two lugs of said connecting member, each of said open top chambers receiving said bolt, said handle being formed at an upper edge with a projection engaged with another end of said spring.

* * * * *